United States Patent [19]

Pardo

[11] Patent Number: 4,977,730

[45] Date of Patent: Dec. 18, 1990

[54] ROOF PAVER ELEMENT AND SYSTEM

[75] Inventor: Jorge Pardo, Reston, Va.

[73] Assignee: National Concrete Masonry Association, Herndon, Va.

[21] Appl. No.: 403,357

[22] Filed: Sep. 6, 1989

[51] Int. Cl.[5] ..... E04B 5/04

[52] U.S. Cl. ..... 52/602; 52/605

[58] Field of Search ..... 52/602, 605, 302, 303, 52/408, 604, 508

[56] References Cited

U.S. PATENT DOCUMENTS

| | | | |
|---|---|---|---|
| 950,060 | 2/1910 | Smith et al. | 52/602 |
| 2,039,183 | 4/1936 | Nagel | 52/602 |
| 3,538,654 | 11/1970 | Gerula | 52/302 X |
| 3,694,982 | 10/1972 | Gerhaher | 52/302 |
| 4,506,483 | 3/1985 | Phalen, Jr. | 52/302 X |
| 4,535,579 | 8/1985 | Burgoyne et al. | 52/302 X |
| 4,655,018 | 4/1987 | Pardo | 52/302 |
| 4,776,144 | 10/1988 | Pardo | 52/585 |

FOREIGN PATENT DOCUMENTS

| | | | |
|---|---|---|---|
| 477661 | 1/1953 | Italy | 52/605 |

*Primary Examiner*—David A. Scherbel
*Assistant Examiner*—Lan Mai
*Attorney, Agent, or Firm*—Lane, Aitken & McCann

[57] ABSTRACT

A roof paver element includes a plurality of ribs projecting from a planar body portion, the ribs terminating in bottom surfaces having rounded longitudinal boundaries. The ribs are connected to the planar body portion and to one another by fillets. Sides of the planar body portions include depressions which form pressure equalization chambers with the sides of the body portions of adjacent roof paver elements in a roof system to hinder the development of air pressure differentials between the region above the roof paver elements and the spaces below the planar body portions.

12 Claims, 2 Drawing Sheets

ROOF PAVER ELEMENT AND SYSTEM

BACKGROUND OF THE INVENTION

The present invention relates to a roof paver element and a roof paver system including a plurality of interconnected roof paver elements for covering roofs, especially for covering the membranes of single-ply roofing systems.

U.S. Pat. No. 4,655,018, issued to the present inventor, discloses a roof paver element and system for replacing the gravel used as roof ballast to hold down roofing membranes of low-slope roofs against the roof deck when wind conditions may create negative pressures tending to lift the membranes. Each roof paver element includes a generally planar portion having an underside from which extend a plurality of parallel ribs defining drainage grooves. The bottoms of the ribs engage the roof membrane and the top surface of the planar portion includes raised portions which generate air vortexes to break up the smooth flow of air across the roof paver elements, which otherwise would tend to lift the elements. The raised portions also define a safety tread which helps prevent workmen and others on the roof from slipping.

The ends of the grooves are shaped to receive connector members to interconnect the roof paver elements and thereby provide greater resistance against wind uplift. Although the shapes of the grooves permit connectors having a circular cross section, such as sections of tubing, to be used, the roof paver elements disclosed in that patent are more efficiently used in connection with the connector disclosed in U.S. Pat. No. 4,776,144 in the name of the present inventor. The connectors disclosed therein are shaped to provide a substantial area of contact with the portions of the roof paver elements defining the grooves, and flange stops project from the connector members to engage the roof paver elements at the ends of the grooves.

The ribs of the aforesaid roof paver elements define a number of edges, including edges at the bottom which might abrade the roof membrane and thereby cause leakage. Fragments of material also have a tendency to chip off the sharp edges during handling of the roof paver elements. Furthermore, the ribs include sharp linear indentations, and similar linear indentations exist at the junctures of the ribs with the underside of the planar body portion. These sharp indentations give rise to stress concentrations and, thus, define the areas most likely to fail if any failure is to occur.

Insofar as wind uplift performance of paver elements is concerned, the flow of air along the tops of the roof paver elements causes a net pressure differential between the area above the roof paver elements and the space in the drainage grooves below the paver. Up to a certain limit, if the wind velocity increases gradually, this pressure differential tends to be equalized by air transmission through the paver joints. However, if the wind surges suddenly, though briefly, the pressure equalization effect may not have time to occur before the net pressure differential exceeds the gravity load of the pavers, and, thus, the wind lifts the elements out of position, especially where the elements are not interconnected.

SUMMARY OF THE INVENTION

In accordance with the present invention, an improved roof paver element eliminates edges and sharp linear indentations on the ribs and adjacent areas on the underside of the roof paver element through the use of rounding at the edges and filleting at the indentations. As a result, the probability of abrading a roof membrane is reduced and the chipping of fragments of material from the ribs is also reduced. Furthermore, stress concentrations are avoided, and the rounding and filleting makes the roof paver elements easier to mold in standard concrete block mold machines by eliminating sharp corners in the mold which are difficult for concrete or other material to fill. Moreover, the rounding and filleting permits the roof pavers to have an even smaller thickness than the roof pavers disclosed in U.S. Pat. No. 4,655,018 without sacrificing strength and while maintaining the ability to receive the connector members usable with those earlier roof paver elements. The reduced thickness results in a smaller volume which allows the concrete or other material to be compacted more, which results in a roof paver element having denser material, giving the element greater strength and greater resistance to freeze-thaw cycles without an increase in weight relative to the earlier roof paver elements. The reduced thickness also permits more roof paver elements to be produced with each operating cycle of a conventional concrete block machine.

The roof paver element according to the present invention also includes an elongate generally planar body portion from which the ribs depend to support the body portion and to define drainage spaces in the form of drainage grooves, the planar body portion having sides defining grooves to form pressure equalization chambers with corresponding grooves on adjacent roof paver elements. These pressure equalization chambers help counteract the effects of momentary surges or gusts in wind velocity which comprise a wind characteristic often causing roof pavers to lift. The pressure equalization chambers provide a volume of air adjacent to the top surface of the elements which can flow quickly to the top surface to offset sudden surges in the wind. An indentation is provided along a rear side of the planar body portion so as to define further pressure equalization chambers with the front surfaces of the planar body portions of adjacent roof paver elements.

DETAILED DESCRIPTION OF THE PREFERRED EMBODIMENT

Figure 1:
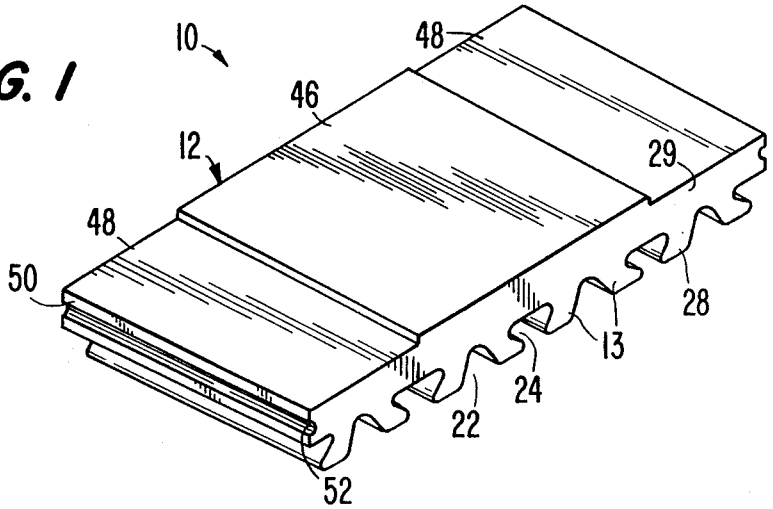
FIG. 1 is a perspective view of a roof paver element according to the present invention.
Figure 2:
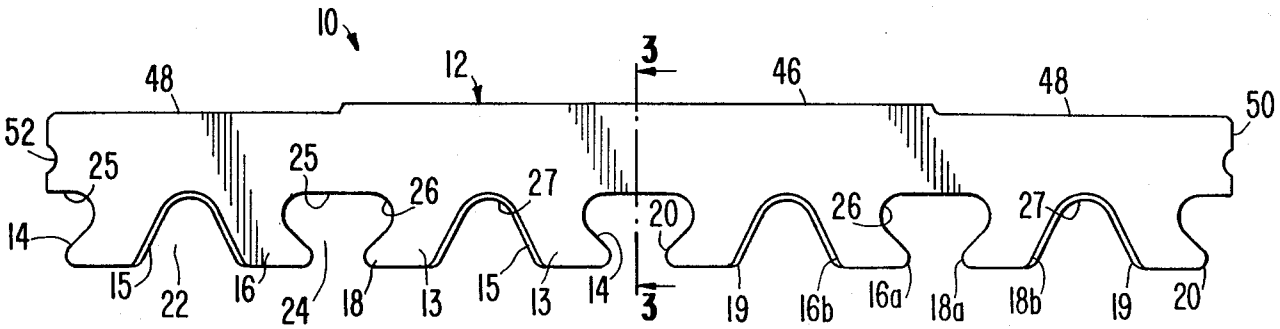
FIG. 2 is a rear elevation of the roof paver element of FIG. 1.

As can be seen from FIGS. 1 and 2, a roof paver element according to the present invention, which is designated generally by the reference numeral 10, is a thin shell block element preferably made of concrete and having dimensions which permit it to be molded readily at high speed in a standard concrete block mold box. For this reason, a preferred embodiment of the roof paver element 10 has nominal dimensions of 16 in.×8 in. so a mold box which can produce standard concrete blocks can produce a plurality of the roof paver elements 10. Due to the thinness of the roof paver elements, the standard mold box can produce many more of them at one time than standard concrete blocks and more, even, than the roof paver elements disclosed in U.S. Pat. No. 4,776,144. The roof paver element 10 includes an elongate generally planar body portion 12 which defines the upper portion of the paver element 10 when the paver element is in place on a roof. The roof paver element 10 further includes a plurality of spaced ribs 13 projecting from the planar body portion 12, having side surfaces 14 and 15, and terminating in broadened feet 16 and 18 which include toe portions **16*a* and 18*a*, respectively, and heel portions 16*b* and 18*b*. Each foot 16, 18 has a bottom surface for contacting the roof, the bottom surfaces having longitudinal boundaries. The area of the bottom surfaces of the feet 16 and 18 which contact the roof, that is, the footprint, is made greater than the cross-sectional area of the ribs 13 above the feet to provide increased weight distribution and to diminish the likelihood of damage to the roof membrane. Furthermore, all of the longitudinal boundaries of the bottom surfaces of the feet 16 and 18 are rounded to eliminate sharp edges, define rounds 19 and 20 and, thereby, further diminish the likelihood of the roof membrane being penetrated by the feet 16 and 18 and the likelihood of fragments being chipped from the ribs. The rounds 19 and 20 are also easier to mold because they are made by molds which do not have sharp corners which are difficult to fill with concrete or other moldable material. As a result, voids are prevented and the concrete is compacted completely and uniformly. The rounds 19 and 20 have a large radius of curvature, typically 0.375 inches for ribs 13 having a height of 1.125 inches in a roof paver element 10 having a height of 2.375 inches. The ribs 13 define drainage spaces in the form of a plurality of drainage grooves comprising alternating tapered grooves 22 and dovetail-shaped grooves 24 on the underside of the planar body portion 12** to allow the drainage of water and to trap air for thermal insulation.

Figure 5:
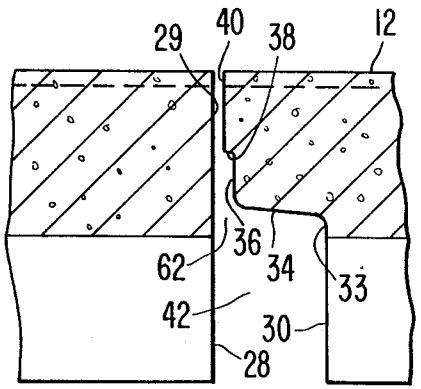
FIG. 5 is a fragmentary cross section showing the front surface of one roof paver element according to the present invention adjacent the rear surface of another and defining another type of pressure equalization chamber.
Figure 4:
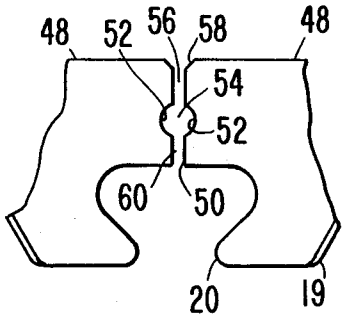
FIG. 4 is a fragmentary rear elevation of adjacent ends of roof paver elements according to the present invention, showing, a pressure equalization chamber formed therebetween.

The roof paver elements 10 are placed in close proximity to one another on a roof to form a roof paver system defining a substantially continuous surface having narrow gaps between the planar body portions 12 of adjacent roof paver elements 10 (FIGS. 4 and 5). The dovetail grooves 24 are adapted to receive connector members for connecting each roof paver element 10 to adjacent roof paver elements in order to provide greater resistance against uplift by wind. Connectors made of short lengths of standard one-inch plastic tubes engage three sides of the dovetail grooves 24 and are suitable for connecting the roof paver elements. However, the roof paver connectors disclosed in the present inventor's U.S. Pat. No. 4,776,144 are specifically designed and better suited to connect the roof paver elements 10. Furthermore, the roof paver elements 10 according to the present invention can be used in connection with the dovetail-shaped battens disclosed in the present inventor's U.S. Pat. No. 4,655,018 to secure the paver elements 10 to a roof and to keep the paver elements from sliding on roofs having a relatively high slope. In many applications, the courses of roof paver elements 10 are staggered to permit total interlocking, but it is understood that the roof paver elements 10 of adjacent courses can be in alignment if desired.

The dovetail grooves 24 are defined between the sides 14 of adjacent ribs 13 from which the toe portions **16*a* and 18*a* of the feet 16 and 18 face one another and extend toward one another, so that the region of the dovetail grooves 24 above the toe portions 16*a* and 18*a* have increased cross-sectional area to accommodate a large volume of drainage. The planar body portion 12 includes a bottom having surfaces 25, which also define the dovetail grooves 24 and connect to the side surfaces 15 of the ribs 13 by fillets 26 to avoid stress concentrations at the juncture of the planar body portion 12 and the ribs 13. The fillets 26 have a large radius of curvature, typically 0.625 inches. The tapered grooves 22, which are defined between the sides 15 of adjacent ribs 13 having the heel portions 16*b* and 18*b* of the feet 16 and 18, taper longitudinally to provide a mechanism for breaking the vacuum between the tapered grooves 22 and the mold as the roof paver elements 10 are slid out of the mold in a direction parallel to the grooves 22 and 24. The breaking of the vacuum between the tapered grooves 22 and the portions of the mold they contact reduces the overall forces retaining the paver elements 10 in the mold so that the elements can be slid out easily. The sides 15 of the ribs 13 converge at the top of the tapered grooves 22, where they are connected by fillets 27 for the purpose of avoiding stress concentrations. The fillets 27 can have a radius of curvature of 0.875 inches, for example. The fillets 26 and 27, by their shape and by avoiding stress concentrations, give the paver elements 10** greater strength.

Figure 3:
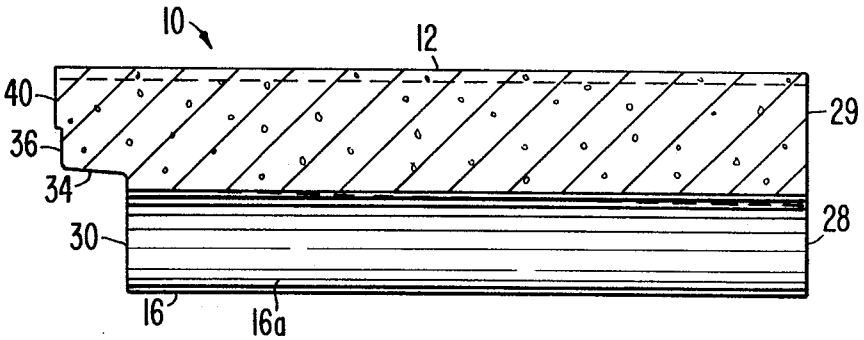
FIG. 3 is a cross section taken along the line 3—3 in FIG. 2.

As can be seen from FIGS. 3 and 5, the feet 16 and 18 have a dimension parallel to the grooves 22 and 24 which is shorter than the parallel dimension of the planar body portion 12. Each foot 16, 18 has a flush end 28 which is coplanar with front side 29 of the planar body portion 26 and a recessed end 30 which is connected by a lower vertical surface 33, a sloped surface 34, a recessed vertical surface 36, and an angled transition surface or shoulder 38 to a rear side 40 of the planar body portion 12. The surfaces 33, 34, 36 and 38 extend parallel to the top of the body portion 12 for the entire distance between lateral sides of the planar body portion 12. The recessed vertical surface 36 has a top side which is connected by the shoulder 38 to the rear side 40 of the planar body portion 12 and a bottom side which is open to a drainage space below the planar body portion 12. When the paver elements 10 are in place on a roof, the space between the recessed ends 30 of the feet 16 and 18 and the adjacent rear edge 40 of the planar body portion 26 defines with the front of an adjacent roof paver element a drainage space in the form of a drainage passage 42 which is transverse to the drainage passages provided by the tapered grooves 22 and the dovetail groove 24. Thus, a transverse drainage passage 42 of single width can be defined between all adjacent courses of paver elements 10. The paver elements 10 can also be laid with the rear sides 40 of adjacent roof paver elements 10 facing and adjacent to one another. By this arrangement, a double width transverse drainage passage (not shown) is defined after every two courses of the paver elements 10, there being no significant transverse drainage where the front sides 29 of the planar body portions 26, which are coplanar with the flush ends 28 of the feet 16 and 18, are adjacent to one another.

As can best be seen from FIGS. 1 and 2, each roof paver element 10 has a bar-shaped raised portion 46 on its upper surface so that, when the roof paver elements 10 are in place on a roof, the raised portions 46 provide a tread for roof traffic, such as maintenance crews and repair men, and also constitute vortex generators which break up the flow of air along the roof paver elements 10. The smooth flow of air across the tops of the roof paver elements 10 can cause uplift and a displacement of the roof paver elements. The raised portion 46 can counter the uplift by creating swirls of air which destroy the production of negative pressure areas causing the uplift. Where heavy roof traffic is expected, such as on a flat roof designed as a patio, the recesses 48 which are defined on opposite sides of the raised portion 46 can be filled in during the molding process to provide the roof paver elements with a smooth top surface. The additional material provides extra weight for the roof paver elements that offsets the loss of vortex generating formations in resisting uplift due to wind. The additional material also provides the roof paver elements with extra strength to withstand the heavier foot traffic. The roofs for which heavier traffic is anticipated can withstand the additional weight of the slightly heavier roof paver elements, since such roofs, which are intended to encounter frequent and heavy roof traffic, are really designed to support the weight that floors support.

The roof paver elements 10 according to the present invention are designed to have lower weight per square foot than other roof paver elements, and so the additional weight of roof paver elements according to the present invention in which the recesses 48 of the planar body portions 12 are filled in by extra material is no burden. Furthermore, the roof paver elements 10 can retain the connector members which are usable with the paver elements disclosed in U.S. Pat. No. 4,655,018. Moreover, the roof paver elements 10 can be formed with a denser concrete or other building material to provide it with extra strength to withstand increased traffic as well as to resist breakup due to the freezing and thawing cycles of water.

Each paver element 10 terminates at its sides with structure defining one-half of a dovetail groove 24, as can be appreciated from FIG. 4. Specifically, each end of the paver element 10 includes one of the ribs 13 spaced inward from a side 50 of the planar body portion 12 by a distance equal to one-half the width of a dovetail groove 24. The outwardly directed toes **16*a* and 18*a* of the ribs 13 define a composite dovetail groove 24 when the end of the paver element 10 is laid next to the end of the adjacent paver element. The composite dovetail grooves 24 are additional drainage spaces, which are capable of holding connector members. The connector members, which are received snugly between aligned dovetail grooves 24 in adjacent roof paver elements 10, enhance the ability of the elements to resist displacement by the wind. The dovetail grooves 24 which are defined entirely within one roof paver element 20 can also receive the connector members, so that a connector member can have one end inserted in a composite dovetail groove 24 and the other end inserted in a dovetail groove 24 defined entirely within one roof paver element 10. The connector members can also connect two dovetail grooves 24 lying entirely within their respective roof paver elements 10 and, where the roof paver elements of adjacent courses are in alignment, the connector members 26 can connect two composite dovetail grooves 24**.

Especially in cases where the connector members are used in dovetail grooves 24 defined entirely within one roof paver element 10, stops radially projecting from the connector members can be used to engage the ends of the ribs 13 to prevent the connector members from being pushed too far into the dovetail groove 24 in a roof paver element 10, as is described in the present inventor's U.S. Pat. No. 4,655,018. Furthermore, clips such as those described in that patent can be used with the roof paver elements at the perimeter of the paving defined by those roof paver elements to anchor the elements in place.

In addition to the features already described to resist the lifting of the roof pave elements 10 by wind flowing across their tops, further features are provided to resist the lifting, especially due to sudden gusts of wind or surges in wind velocity. As can be seen from FIGS. 1, 2 and 4, the lateral sides 50 of the planar body portions 26 each include a depression in the form of a groove 52 extending substantially horizontally from the front side 29 to the rear side 40 of the planar body portion 12. The grooves 52 are parallel to the top surface of the planar body portion 12 and to the ribs 13. When the roof paver elements 10 are on a horizontal roof, the grooves 52 are substantially horizontal. When the roof paver elements !0 are on a sloping roof, the orientation of the grooves 52 corresponds to the slope of the roof.

As can be seen from FIG. 4, the horizontal grooves 52 of adjacent roof paver elements 10 cooperate to define a pressure equalization chamber 54, which is in fluid communication with the space above the roof paver elements 10 by means of a narrow upper elongate passage 56 having a flared mouth 58 at the top surface of the recessed portions 48 of the planar body portions 12. The upper elongate passage 56 is defined by part of the gap between adjacent lateral sides 50 of the planar body portions 12 above the horizontal groove 52, and the mouth 58 is defined by beveled surfaces extending between the sides 50 of the planar body portions 12 and the top surfaces of the recesses 48. The pressure equalization chambers 54 are in fluid communication with the drainage space under the planar body portions 12 through a lower elongate passage 60 also defined by the gap and, more specifically, by portions of the lateral edges 50 below the horizontal grooves 52.

It is believed that the pressure equalization chambers hinder the development of air pressure differentials between the drainage spaces and the region above the roof paver elements 10 by exhausting the reservoir of air they contain through the upper elongate passage 56 and the mouth 58 in response to a sudden gust of wind causing a quickly developed low pressure area at the top of the roof paver elements 10. The air in the pressure equalization chamber 54 tends to prevent the pressure differential between the drainage spaces and the region above the planar body portions 12 from becoming too great by reducing the distance to the bottom chambers. If the pressure differential between that upper region and the drainage spaces develops slowly, air can flow from the drainage spaces on the underside of the roof paver elements 10 through the gap between the planar body portions 12 to the surface, and additional air could flow into the space vacated by air flowing to the top to maintain the pressures in the region above the planar body portions 12 and the drainage spaces relatively equal and, thereby, prevent uplift. However, when the change in pressure is sudden, air from the drainage spaces is unable to move quickly enough to the top of the planar body portions 12 to cause equalization, since the drainage space below the planar body portions 12 is larger than the area of the gap, with the result that a large pressure difference develops and the roof paver elements are lifted out of position. By providing a supply of air closer to the top surface of the roof paver elements 10 to equalize the pressures, the uplifting effects of sudden gusts of wind are diminished. The beveled surfaces defining the mouth 58 improve the flow of air from the pressure equalization chamber 54 and the elongate upper flow passage 56 to the region above the roof paver elements 10. They also form another irregularity along the top surfaces of the roof paver elements and, thereby, help to generate the vortexes which reduce or destroy the development of low pressure areas above the roof paver elements 10.

As can be seen best from FIG. 5, additional pressure equalization chambers 62 are provided at the juncture of the rear side 40 of each planar body portion 12 with the front side 29 of the planar body portion 12 of the adjacent roof paver element 10. The additional pressure equalization chambers 62 include a first portion defined between the front side 29 of one planar body portion 12 and the recessed vertical surface 36 on the rear side 40 of the adjacent planar body portion 12. A second portion of the additional equalization chambers 62 is defined under the sloped surface 34, between the lower vertical surface 33 of one planar body portion 12 and the portion of the front side 29 in alignment with the lower vertical surface 33. The additional pressure equalization chambers 62 are believed to be effective for reasons similar to those described in connection with pressure equalization chambers 54.

Although the roof paver element according to the present invention is described herein as being made of concrete, other suitable materials may be employed, such as ceramics or plastics. Furthermore, the roof paver elements may be employed in structures other than as part of a roof paver system. Thus, it will be appreciated that the present invention provides a highly effective roof paver element and system for covering roofs. Moreover, it will be apparent to those skilled in the art and it is contemplated that variations and/or changes in the embodiments illustrated and described herein may be made without departure from the present invention. Accordingly, it is intended that the foregoing description is illustrative only, not limiting, and that the true spirit and scope of the present invention will be determined by the appended claims.

I claim:

1. A system of roof paver elements for providing ballast for a roof comprising:

a plurality of roof paver elements each comprising a body portion having a top, a bottom, and sides extending between the top and the bottom, wherein the roof paver elements are positioned in close proximity to one another to define a substantially continuous surface having narrow gaps between adjacent body portions;

means for defining drainage spaces below said body portions and between adjacent roof paver elements, wherein the area of the drainage space between two adjacent roof paver elements is larger than the area of the gap between the body portions of said two roof paver elements; and means for hindering the development of air pressure differentials between said drainage spaces and a region above said roof paver elements, said hindering means comprising a depression defined in a side of at least one of the body portions defining the gaps, whereby a pressure equalization chamber is formed between said adjacent body portions.

2. The roof paver system according to claim 1, wherein said depression comprises a groove extending generally parallel to the top of the body portion.

3. The roof paver system according to claim 1, wherein said groove faces and cooperates with a like groove in the body portion of an adjacent roof paver element to form the pressure equalization chamber.

4. The roof paver system according to claim 1, further comprising a bevel between the top of the body portion and the side of the body portion in which the depression is defined, thereby forming a flared mouth for the gap.

5. The roof paver system according to claim 4, wherein said bevel lies adjacent a corresponding bevel on the body portion of an adjacent roof paver element.

6. The roof paver system according to claim 1, wherein the depression comprises a recessed surface connected by a shoulder to the side of the body portion, between said recessed surface and the top of said body portion, said recessed surface having a side opposite to the top of said body portion, said side of said recessed surface being open to the drainage spaces.

7. The roof paver system according to claim 6, wherein said depression further comprises surfaces extending from the open side of the recessed portion farther into said body portion and down to the bottom of said body portion.

8. The roof paver element according to claim 7, wherein said recessed surface extends the entire distance between the lateral sides of the body portion in which the recessed surface is defined.

9. The roof paver element according to claim 6, wherein said recessed surface has a length substantially parallel to the top of the body portion in which the recessed surface is defined.

10. The roof paver system according to claim 1, wherein each roof paver element comprises means for supporting said body portion, and said means for defining drainage spaces comprises a part of said body portion of at least one of said two adjacent roof paver elements extending beyond said supporting means toward the adjacent roof paver element.

11. The roof paver system according to claim 10, wherein said supporting means comprises a plurality of ribs projecting from said body portion.

12. A roof paver element for providing ballast for a roof, comprising:

a body portion having a top, a bottom, and sides extending between the top and the bottom;

means for defining drainage spaces under said body portion, said body portion extending laterally beyond said drainage space defining means to define a drainage space;

means for hindering the development of air pressure differentials between said drainage spaces and a region above the roof paver elements when a plurality of the roof paver elements are positioned in close proximity to one another to define a substantially continuous surface, said hindering means comprising a depression defined in a side of said body portion.

* * * * *